United States Patent [19]

Groover

[11] Patent Number: 4,722,455

[45] Date of Patent: Feb. 2, 1988

[54] INCREASED COLUMN/SELECTIVITY VENDER

[75] Inventor: Phillip B. Groover, Woodstock, Ga.

[73] Assignee: The Coca-Cola Company, Atlanta, Ga.

[21] Appl. No.: 911,152

[22] Filed: Sep. 24, 1986

[51] Int. Cl.[4] ..... G65G 59/00; A47F 1/00

[52] U.S. Cl. ..... 221/67; 221/131; 221/281; 312/45; 312/72

[58] Field of Search ..... 221/67, 92, 109, 119–124, 221/129, 131–133, 197, 242, 281; 312/45, 72, 73; 211/49.1, 162, 74

[56] References Cited

U.S. PATENT DOCUMENTS

| | | | |
|---|---|---|---|
| 2,212,797 | 8/1940 | Smith | 221/109 |
| 3,348,733 | 10/1967 | Johnson | 221/6 X |
| 3,883,038 | 5/1975 | Bookout | 221/242 X |
| 4,057,171 | 11/1977 | Hatori | 221/131 X |
| 4,109,825 | 8/1978 | Weitzman | 221/122 X |
| 4,368,829 | 1/1983 | Lotspeich et al. | 221/75 |

*Primary Examiner*—Joseph J. Rolla
*Assistant Examiner*—Gregory L. Hvison
*Attorney, Agent, or Firm*—Birch, Stewart, Kolasch & Birch

[57] ABSTRACT

A space-to-sales vend rack including a plurality of adjacent vend columns having a wide range of respective storage capactities, first columns are provided for supporting products in vertical stacks with the longitudinal axes of the products orthogonal to the vending machine face, other columns are provided for supporting products in vertical stacks with the longitudinal axes of the products parallel to the vending machine face. The products with axes parallel to the front face of the vending machine are supported on slide-out racks for ease of loading.

10 Claims, 5 Drawing Figures

INCREASED COLUMN/SELECTIVITY VENDER

BACKGROUND OF THE INVENTION

The present invention relates to a vend rack for a vending machine that stores soft drink bottles or cans and feeds the same to a discharge port in the front of a vending machine in a uniform manner. More specifically, the present invention relates to a vend rack mechanism having the flexibility of storing selected numbers of vendable bottles or cans in separately accessible vend columns.

One of the most widely used conventional vend racks for bottles and cans in a vending machine includes a plurality of side-by-side, vertical storage columns, each of which communicates with a discharge port in the front of a vending machine. These columns are disposed in parallel relationship, and the quantity of vendable products therein is usually controlled by dimensioning the width of the columns to receive either a double row of nestable bottles or cans or a single stacked row of bottles or cans. These columns may either be one-deep, two-deep or three-deep, depending on the depth of the vending machine cabinet. This conventional vend rack suffers from the disadvantage that there is little flexibility in choice of the number of vendable products that can be stored in the respective columns. Therefore, it is difficult to match product demand with storage capacity for any given column for a vending machine of this type which conventionally contains from five to nine selectable products from seven to ten columns.

The demand for different types of products may depend on sales location or general popularity. In addition, in vending machines such as described in U.S. Pat. No. 4,380,130 to Bachmann, et al., issued Apr. 19, 1983 and assigned to the same assignee as the present invention, product sales or demand is also influenced by the unique styling of the vending machine including the use of an enlarged primary product selection button adjacent the coin slot of the vending machine. Accordingly, the need for more flexibility in product storage and delivery from the respective chutes of a vend rack are even more acute in a vending machine such as described in the Bachmann, et al. Patent.

One attempt to provide greater column selectivity in a vender is disclosed in U.S. Pat. No. 4,245,755 to Craven et al. In Craven, some increased selectivity is achieved by a communicating slant shelf extension of a column for which the storage capacity is to be increased. However, even the Craven apparatus has limited selectivity.

SUMMARY OF THE INVENTION

Accordingly, it is a primary object of the present invention to provide a vend rack for a plural product vending machine having the ability to store and supply a large number of high-demand, high-selling, vendable products in one or more large-capacity vend columns, and to store and supply low-selling vendable products in lower capacity vend columns.

It is a further object of the present invention to provide a vend rack with greater flexibility for the variation of storage capacities of different types of vendable products within a machine of the same overall storage volume as conventional machines, including a plurality of juxtaposed, vertical storage columns.

It is yet another object of the present invention to provide a vend rack structure for use in a multipleproduct vending machine which facilitates matching of the capacity of the respective vend columns with product demand so that the respective chutes containing the different products will theoretically become empty about the same point in time, thereby reducing the number of service calls for refilling the machine.

It is still another object of the present invention to provide a vend rack which may be easily retrofit into existing vending machines which presently utilize conventional, vertical column vend racks.

The objects of the present invention are fulfilled by providing a vend rack assembly for delivering vendable cylindrical products to a discharge port in the face of a vending machine, comprising:

a plurality of vertical columns disposed side-by-side in parallel relationship behind the face of the vending machine, the bottom of each of the columns communicating with the discharge port, first ones of said columns including means for supporting products in vertical stacks with the longitudinal axes of the products, orthogonal to said vending machine face, other ones of said columns including means for supporting products in vertical stacks with the longitudinal axes of the products parallel to said vending machine face.

The columns are collectively contained side-by-side within a substantially rectangular frame of substantially the same size as a conventional, vertical column vend rack, so it may be easily retrofit into existing vending machines.

BRIEF DESCRIPTION OF THE DRAWINGS

The objects of the present invention and the attendant advantages thereof will become more readily apparent by reference to the following drawings wherein like numerals refer to like parts and wherein.

DETAILED DESCRIPTION OF PREFERRED EMBODIMENTS

Figure 1:
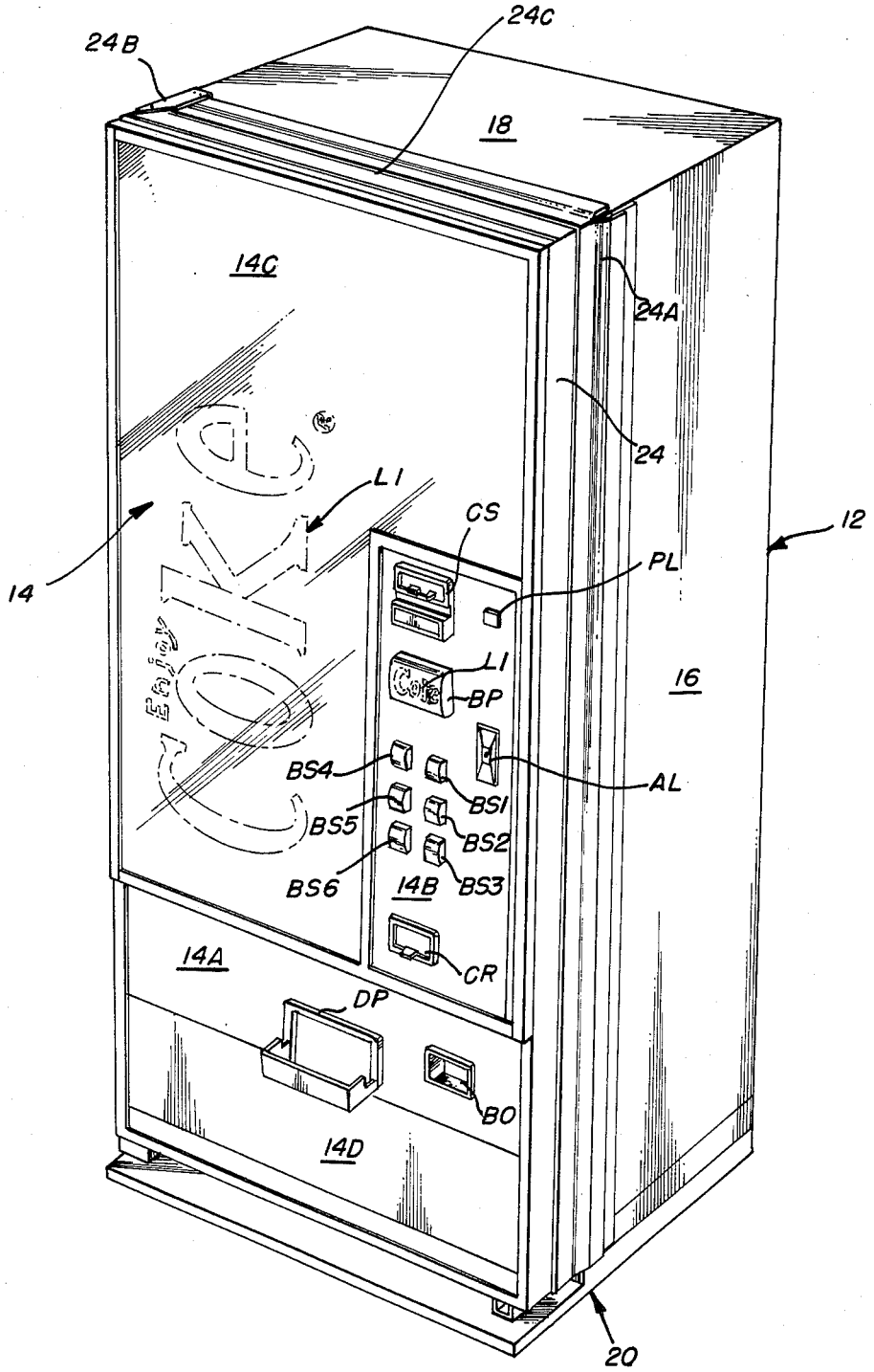
FIG. 1 (PRIOR ART)
FIG. 1 is perspective view illustrating a vending machine of the type disclosed in U.S. Pat. No. 4,380,130, issued Apr. 19, 1983 to Bachmann, et al.

Referring to FIG. 1, an exemplary vending machine 12, incorporating a display panel 14, is illustrated as being a basically three-dimensional, rectangular structure having vertical sides 16 joining horizontal top and bottom sides 18 and 20, respectively. The structure of the vending machine 12 is completed by a flat planar rear surface and a front panel comprising a door 24 which includes the display panel 14 as the obverse face thereof.

The door 24 includes a sealing skirt 24A along one vertical edge thereof and is provided with hinges 24B at the top and bottom of the door on the opposite vertical side thereof to permit access to the interior of the vending machine 12. The bottom surface 20 of the vending machine 12 is illustrated as a load bearing pad or the like which extends outwardly from the main body portion of the machine 12 beneath the door structure 24 and display panel 14.

A further overlapped sealing skirt structure 24C extends across the top of the door 24 and cooperates with the top surface 18 of the vending machine 12.

The display panel 14 includes a first transversely disposed, opaque field section 14A located below the median height of the panel 14 in the preferred embodiment illustrated, in which a discharge port DP and a bottle opener BO are positioned side-by-side.

A second opaque field 14B comprising the selection control portion of the display panel 14 is basically rectangular in shape in the embodiment illustrated and extends vertically from the upper right-hand side of the transversely disposed first opaque field 14A.

The remaining area above the uppermost edge of the first opaque field 14A and the top of the display panel 14 is of an inverted L shape which is completely defined by a first contrasting panel 14C which is translucent and is back-lighted in a manner well known in the art, such as for example, the back-lighting arrangement illustrated in U.S. Pat. No. 4,245,730 to Bachmann, et al., for "Display Panel For A Vending machine", issued Jan. 20, 1981. The first contrasting panel 14C carries a logo L which is printed out for illustration and which, in the embodiment shown, serves to suggest, in combination with the manner of positioning the logo L thereon, a container shaped such as a can of the beverage "COCA-COLA", a Registered Trademark of The Coca-Cola Company of Atlanta, Ga. The logo illustrated is for "COKE" which is also a well-known Registered Trademark of that company. Thus, the first contrasting panel with its logo serves to suggest to a potential purchaser utilizing the vending machine 12, a can of "COKE".

Beneath the lower edge of the first opaque field 14A is a transversely disposed, second contrasting panel 14B which can be of various configurations or contrasting color zones, and constitutes a transversely disposed, rectangular field which, in combination with the shape (inverted L) of the first contrasting panel 14C, provides a suggestion of the letter "C", which is a an abbreviation for "COKE", the logo displayed on the first contrasting panel.

The presentation of goods within the vending machine 12 and the selection thereof for vending is accomplished by the second opaque field (control panel) 14B which includes the following components:

At the uppermost edge of the control panel 14B is a coin slot and return mechanism CS adjacent to which is a pricing label PL which displays a price for the various goods to be dispensed by the vending machine 12.

Beneath the coin slot mechanism CS is an enlarged primary product selector button BP which subtends two vertical columns of secondary product selector buttons BS1 through BS6, the secondary product selector buttons BS1–BS3 constituting one column and the secondary product selector buttons BS4–BS6 constituting a second vertical column parallel to the first.

All of the product selector buttons BP, BS1 . . . , BS6 carry various logos or symbols identifying the products corresponding thereto within the vending machine 12.

In the case of the primary product selector button BP, the logo L1 therein is identical to the logo L on the first contrasting panel 14C. This combination of the primary product logo L with its abstract suggestion of a can of the primary product beverage, in this specific example, together with the identical logo L1 on the primary product selector button BP provides a strong and effective inducement to a purchaser to purchase the primary product in the machine 12 in preference to all of the secondary products provided thereby.

This inducement to purchase is further enhanced by the combination of shapes presented by the first and second contrasting panels 14C and 14D, respectively, which superimpose an additional effect of a character which is an abbreviation for the primary product. This abbreviation for the primary product can also be an abbreviation for the manufacturer of the primary product depending upon the combined effect desired.

The control panel 14B (second opaque field) is completed by the provision of an access locking mechanism AL at the right-hand edge thereof in a relatively medial position and a coin return slot CR at the lowermost edge portion thereof.

Preferably, the selector buttons BP, BS1 . . . BS6 all are provided with translucent indicia, and are back-lighted in a suitable manner known in the art to further emphasize and present the purchaseable contents of the vending machine 12 to a potential customer. The back-lighting of the enlarged primary product selector button BP even further augments the presence of that primary product selector button and provides it with even more dominance over the subtended secondary product selector buttons BS1 . . . BS6 in the two vertical columns therebeneath.

Figure 2:
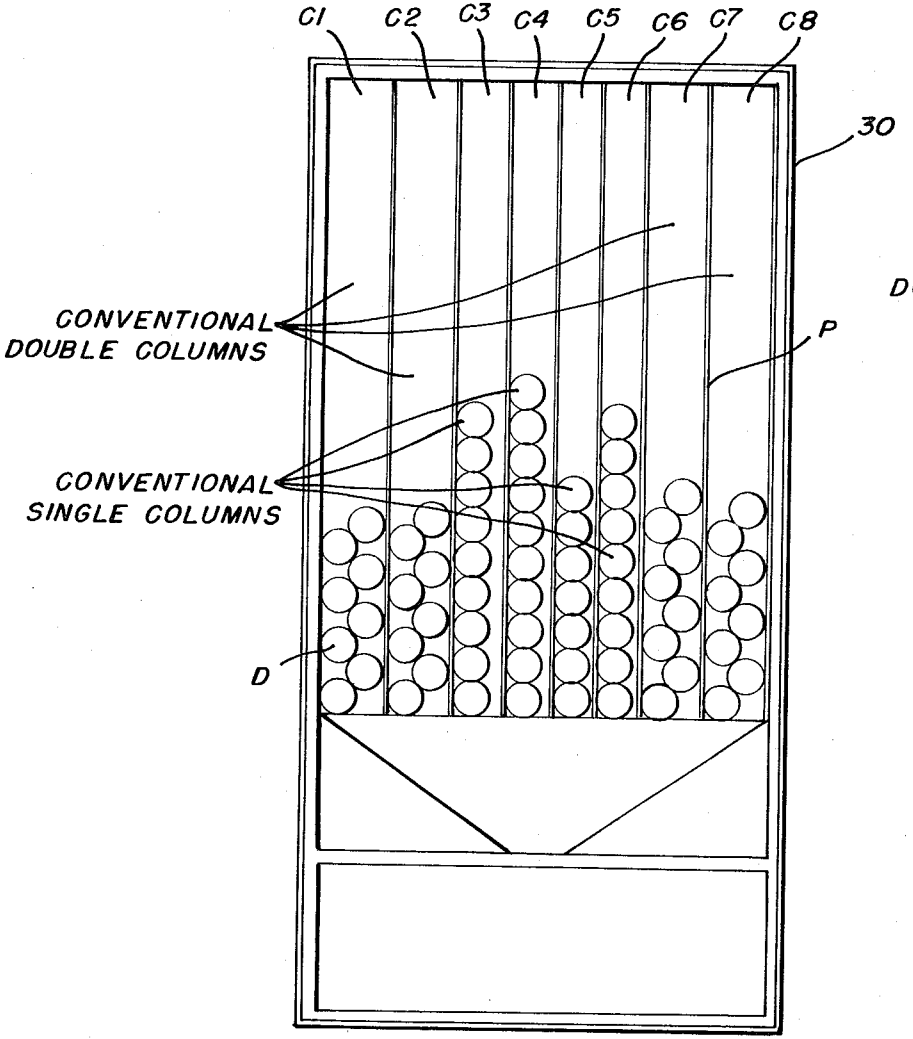
FIG. 2 is a diagrammatic illustration of a prior art vend rack mechanism including only vertical storage columns disposed within a generally rectangular frame.

Referring to FIG. 2, there is illustrated a conventional vend rack including a plurality of vertical storage columns defined by vertical partitions P disposed within a substantially rectangular, box-like frame 30. Articles to be vended such as softdrink cans D are disposed in these respective, vertical-storage columns either one-, two-, or three-deep, into the plane of the paper of FIG. 2, depending on the depth of the vending machine utilized. These cans D are selectively dispensed from these columns to discharge ports such as DP in the vending machine of FIG. 1 by conventional vending mechanisms including appropriate mechanical gating means and vend motors which are actuated in response to the depression of one of the selector buttons illustrated in the vending machine of FIG. 1. The FIG. 2 vend rack includes eight vend columns, C1 to C8, which would be conventionally associated with eight selection buttons on the face of a vending machine. However, if the vending machine of FIG. 1 is utilized, including an enlarged primary product, selection button BP, chutes C1 and C2 might both be operatively associated with the actuation of the enlarged primary product selection button BP.

Figure 3:
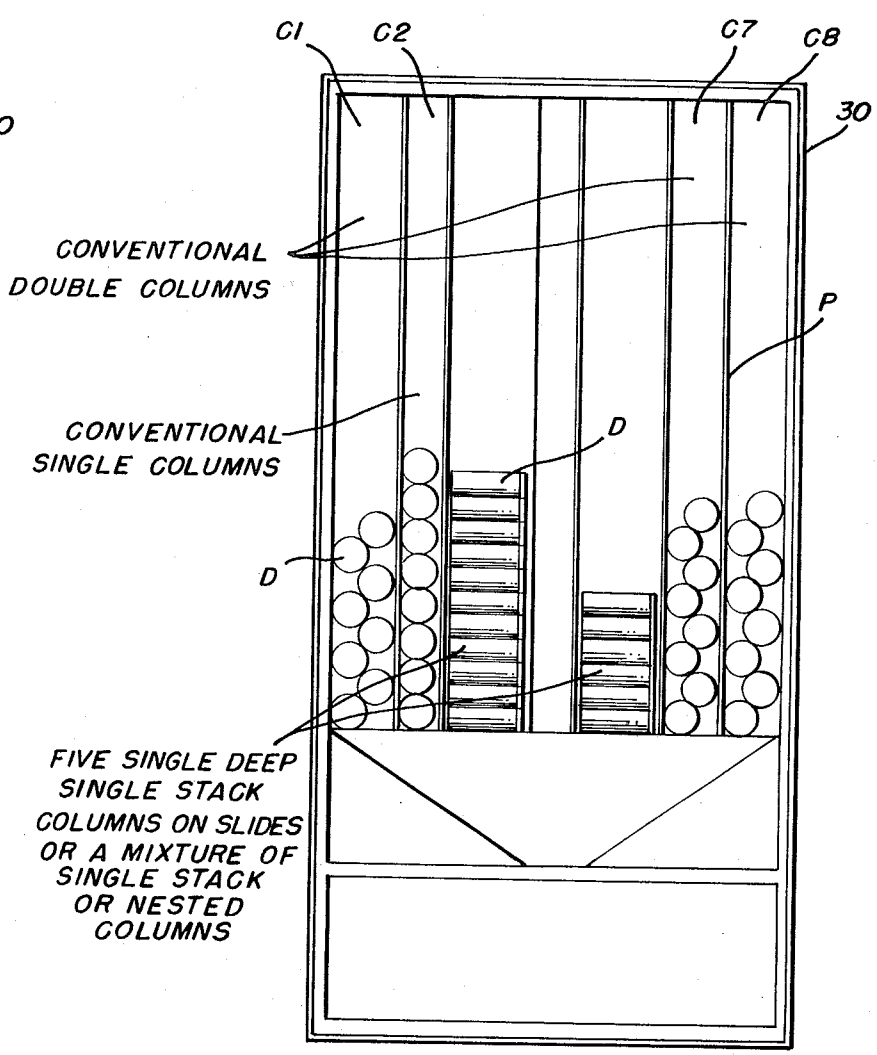
FIG. 3 is a diagrammatic plan view of a vend rack according to the present invention, as would be seen through the front wall of the vending machine of FIG. 1 with the door open.
Figure 5:
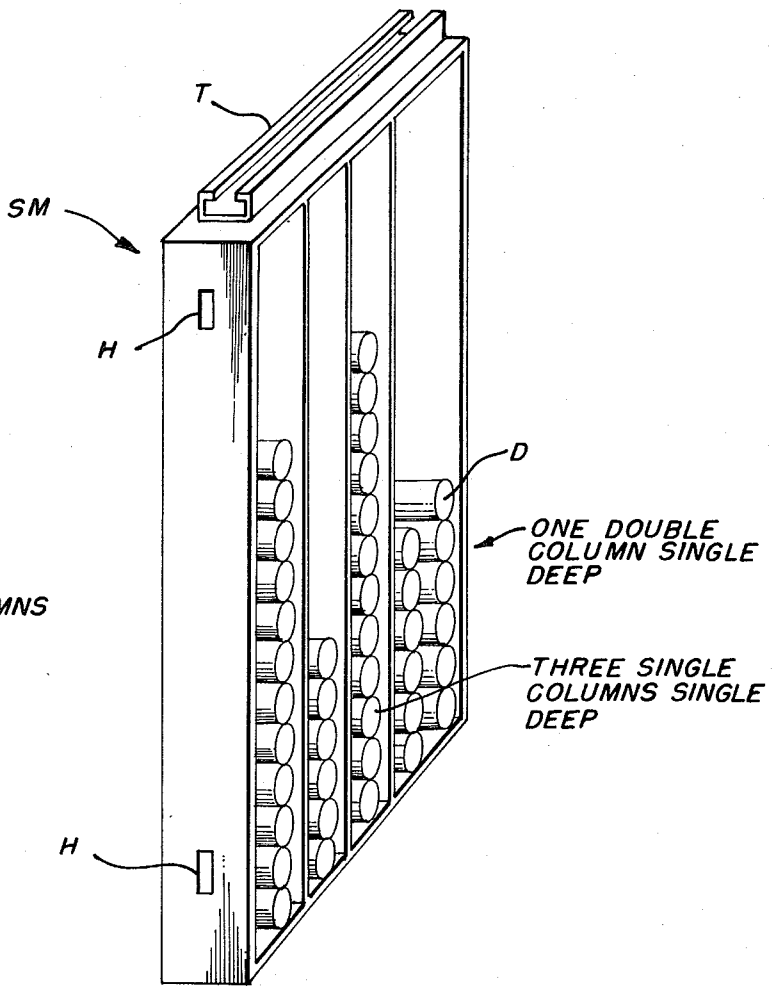
FIGS. 4 and 5 are perspective views of slide out vend rack assemblies with different stack configuration for supporting the products of FIG. 3 with longitudinal axes parallel to the front face of the vending machine.
Figure 4:
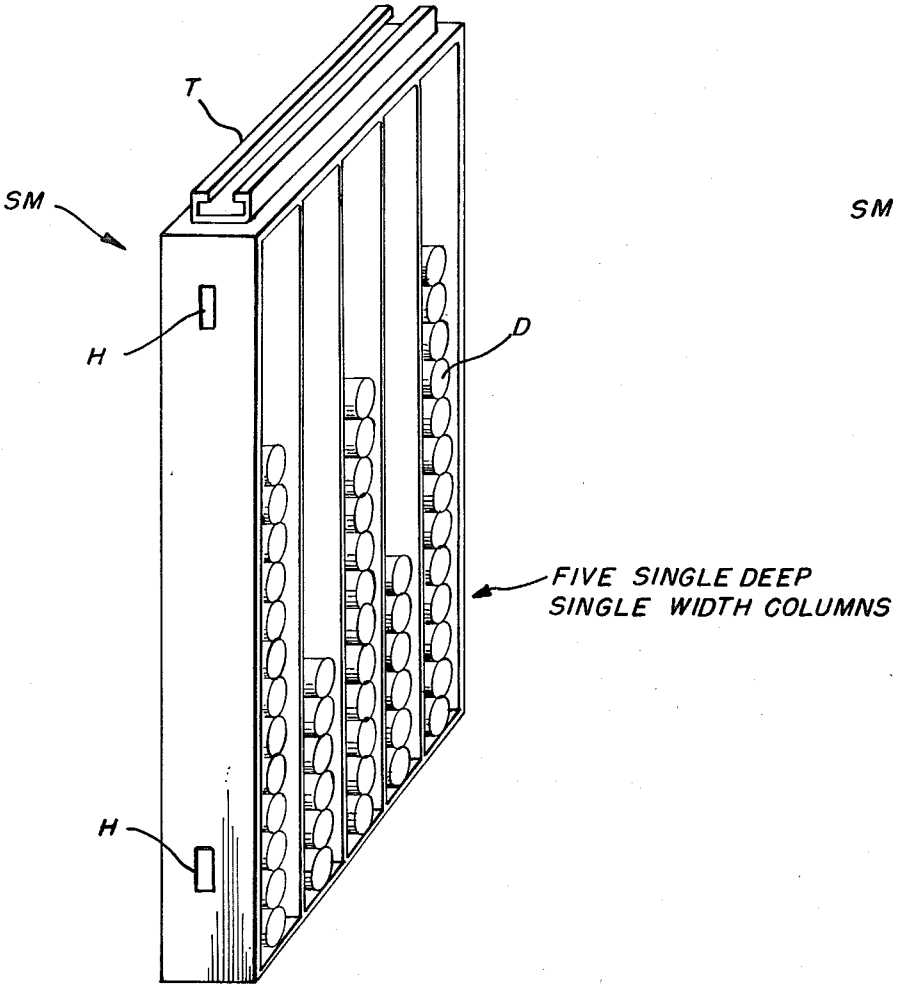

Referring to FIGS. 3 to 5, a first embodiment of the vend rack of the present invention is illustrated within a box-like rectangular frame 30 of substantially the same volume as the conventional rack of FIG. 2, but columns C3 to C6 are replaced with a pair of slide-out vend racks SM wherein the longitudinal axes of cans D are parallel to the front face of the vending machine. The cans D are supported in a plurality of vertical stacks one-behind-the-other in a direction extending from the front face of the vending machine on slide mechanisms, including a track T having a mating component within the vending machine cabinet. The vend racks SM are also provided with handles H to enable them to be slid to outboard positions of the front face of the vending machine for ease of loading the cans D therein.

In the embodiment illustrated in FIG. 4, the vend rack SM is provided with five single-deep, single-width stacks of cans D; while in the embodiment of FIG. 5, the vend rack SM is provided with three single columns single-deep and one double column single-deep. Accordingly, the selectivety of products front-to-back within each of the vend rack mechanisms SM may be adjusted as desired.

In a preferred embodiment of the present invention, the cans of product D stored on the slide mechanisms SM are preferably the secondary products which will be in lower demand. The higher demand products are preferably stored in columns such as C1, C2, C7 and C8 of FIG. 3 since those columns will hold a larger number of cans.

In addition, each of the vertical stacks extending front-to-back of the vending machine within the slide-out vend racks SM may be separately accessible by associating a vend motor with each of the respective vertical stacks and associating that stack with a selected one of the secondary product selector buttons on the face of the vending machine illustrated in FIG. 1.

Accordingly, it can be seen that a large amount of selectively can be achieved in dispensing products within the vending machine of the present invention due to the large variety of column and stacking arrangements possible within the storage area of the machine.

It should be further understood that many other variations of the vend rack described herein may be made, as would occur to one of ordinary skill in the art without departing from the general spirit and scope of the present invention.

What is claimed is:

1. A vend rack assembly for delivering vendable cylindrical products to discharge port means in the face of a vending machine comprising:

a plurality of vertical columns disposed side-by-side in parallel relationship behind said face of said vending machine, the bottom of each of said columns communicating with said discharge port means, first ones of said columns including means for supporting products in vertical stacks with the longitudinal axes of the products orthogonal to said vending machine face, other ones of said columns including means for supporting products in vertical stacks with the longitudinal axes of the products parallel to said vending machine face.

2. The vend rack according to claim 1, wherein said columns are collectively contained side-by-side within a substantially rectangular area as viewed from the front of said vending machine.

3. The vend rack according to claim 1, wherein selected ones of said first vertical columns are dimensioned to accommodate nested double stacks of said vendable products transversely of the vending machine face and other ones of said first vertical columns are dimensioned to accommodate single stacks of vendable products transversely of the vending machine face.

4. The vend rack assembly according to claim 1 wherein the means for supporting included within said other ones of said columns comprises rack means for supporting a plurality of vertical stacks, one behind the other, in a direction extending from said face, said rack means being slidable to positions outboard of said front face for loading said products.

5. The vend assembly of claim 4 wherein the means for supporting included within said first ones of said columns supports a plurality of vertical stacks of said products, one behind the other, in a direction extending from said vending machine face.

6. A vending machine for storing and delivering a plurality of vendable cylindrical products to discharge port means in the face thereof, said vendable products including primary, high demand products and secondary lower demand products, said vending machine comprising:

(a) a product selection panel including primary product selectors and secondary product selectors;

(b) a vend rack assembly for delivering the vendable products to the discharge port means in the face of a vending machine including, a plurality of vertical columns disposed side-by-side in parallel relationship behind said face of said vending machine, the bottom of each of said column portions communicating with said discharge port means, first ones of said columns including means for supporting products in vertical stacks with the longitudinal axes of the products orthogonal to said vending machine face, other ones of said columns including means for supporting products in vertical stacks with the longitudinal axes of the products parallel to said vending machine face;

(c) vend initiation means responsive to said selectors for releasing vendable products from the bottom of the vertical columns, at least one vend initiation means being associated with each column; and (d) means operatively connecting said primary product selectors with vend initiation means of one or more of said first ones of said columns and said secondary product selectors with said other ones of said columns;

whereby primary, high demand products may be stored in said said first ones of said columns and said secondary, lower demand products may be stored in said other ones of said columns.

7. The vending machine according to claim 6, wherein said columns are collectively contained side-by-side within a substantially rectangular area as viewed from the front of said vending machine.

8. The vending machine according to claim 6, wherein selected ones of said first vertical columns are dimensioned to accommodate double stacks of said vendable products and other ones of said first vertical columns are dimensioned to accommodate single stacks of vendable products.

9. The vending machine according to claim 6, wherein the means for supporting included within said other ones of said columns comprises rack means for supporting a plurality of vertical stacks, one behind the other, in a direction extending from said face, said rack means being slidable to positions outboard of said front face for loading said products.

10. The vending machine according to claim 9, wherein the means for supporting included within said first ones of said columns supports a plurality of vertical stacks of said products, one behind the other, in a direction extending from said vending machine face.

* * * * *